US007713023B2

(12) United States Patent
Hamlin et al.

(10) Patent No.: US 7,713,023 B2
(45) Date of Patent: May 11, 2010

(54) STEAM TURBINE NOZZLE BOX AND METHODS OF FABRICATING

(75) Inventors: Michael Thomas Hamlin, Burnt Hills, NY (US); David Alan Caruso, Ballstone, NY (US); Charles T. O'Clair, Waterford, NY (US)

(73) Assignee: General Electric Company, Schenectady, NY (US)

( * ) Notice: Subject to any disclaimer, the term of this patent is extended or adjusted under 35 U.S.C. 154(b) by 795 days.

(21) Appl. No.: 11/470,322

(22) Filed: Sep. 6, 2006

(65) Prior Publication Data

US 2008/0056891 A1 Mar. 6, 2008

(51) Int. Cl.
*F01D 9/04* (2006.01)

(52) U.S. Cl. ..... 415/185; 415/203

(58) Field of Classification Search ..... 415/80, 415/81, 185, 101, 103, 93, 183, 184, 203, 415/212.1

See application file for complete search history.

(56) References Cited

U.S. PATENT DOCUMENTS

| | | | |
|---|---|---|---|
| 5,392,513 | A | 2/1995 | Mazzola et al. |
| 5,927,943 | A | 7/1999 | Maier |
| 6,196,793 | B1 | 3/2001 | Braaten |
| 6,416,277 | B1 | 7/2002 | Manges, Jr. |
| 6,631,858 | B1 | 10/2003 | Farineau et al. |
| 6,754,956 | B1 | 6/2004 | Tomko et al. |

FOREIGN PATENT DOCUMENTS

| | | | |
|---|---|---|---|
| JP | 54153906 | A * | 12/1979 |
| JP | 63038605 | A * | 2/1988 |

* cited by examiner

*Primary Examiner*—Richard Edgar
(74) *Attorney, Agent, or Firm*—Armstrong Teasdale LLP

(57) ABSTRACT

A method of fabricating a steam turbine nozzle box is provided, wherein the method includes forming an annular chamber defined by a radially outer wall and a radially inner wall and coupling a plurality of inlets in flow communication with the annular chamber such that steam is discharged from each of the plurality of inlets into the chamber at an oblique discharge angle with respect to an inlet axial centerline.

20 Claims, 8 Drawing Sheets

STEAM TURBINE NOZZLE BOX AND METHODS OF FABRICATING

BACKGROUND OF THE INVENTION

This invention relates generally to steam turbines and, more particularly, to a nozzle box for use with a steam turbine.

At least some known steam turbines include a nozzle box that facilitates channeling fluid towards a first stage of a turbine. At least some known nozzle boxes each include a plurality of inlets, an annular region, and a plurality of discharge nozzles. The inlets channel steam into the annular region. Because the steam discharged from each inlet typically varies in pressure, the annular region facilitates mixing the steam discharged from the various inlets to provide a substantially evenly distributed pressure of steam throughout the region. The steam is discharged from the annular region through the plurality of nozzles towards the first stage of turbine rotors.

The annular regions of at least some known nozzle boxes have a circular cross-section. Moreover, at least some known nozzle box inlets are oriented such that steam is discharged into the annular region in a direction that is substantially perpendicular to a line extending tangentially to the region. However, the circular cross-section of the annular region and the orientation of the inlets may result in an uneven flow distribution throughout the annular region such that portions of the annular region may be deprived of steam flow. Such uneven flow may create an uneven steam pressure distribution which may induce vibrations within the turbine when the steam is discharged through the nozzles at uneven pressures. Continued operation with such vibrations may decrease the useful life of the turbine and/or increase maintenance costs associated with the turbine.

BRIEF DESCRIPTION OF THE INVENTION

In one aspect, a method of fabricating a steam turbine nozzle box is provided, wherein the method includes forming an annular chamber defined by a radially outer wall and a radially inner wall and coupling a plurality of inlets in flow communication with the annular chamber such that steam is discharged from each of the plurality of inlets into the chamber at an oblique discharge angle with respect to an inlet axial centerline.

In another aspect, a steam turbine nozzle box is provided, wherein the nozzle box includes an annular chamber defined by an outer annular wall and an inner annular wall that is radially inward from the outer annular wall and a plurality of inlets coupled in flow communication with the annular chamber. The inlets are positioned to facilitate discharging steam into the annular chamber at an oblique discharge angle with respect to an inlet axial centerline.

In a further aspect, a steam turbine is provided, wherein the steam turbine includes a turbine and a nozzle box configured to channel steam into the nozzle box for use with the turbine. The nozzle box includes an annular chamber, a plurality of inlets, and a plurality of nozzles. The annular chamber is defined by an outer annular wall and an inner annular wall that is radially inward from the outer annular wall. The plurality of inlets are coupled in flow communication with the annular chamber such that the inlets discharge steam therefrom into the annular chamber at an oblique discharge angle with respect to an inlet axial centerline. The plurality of nozzles are coupled in flow communication with the annular chamber and are configured to discharge steam towards the turbine.

DETAILED DESCRIPTION OF THE INVENTION

Figure 1:
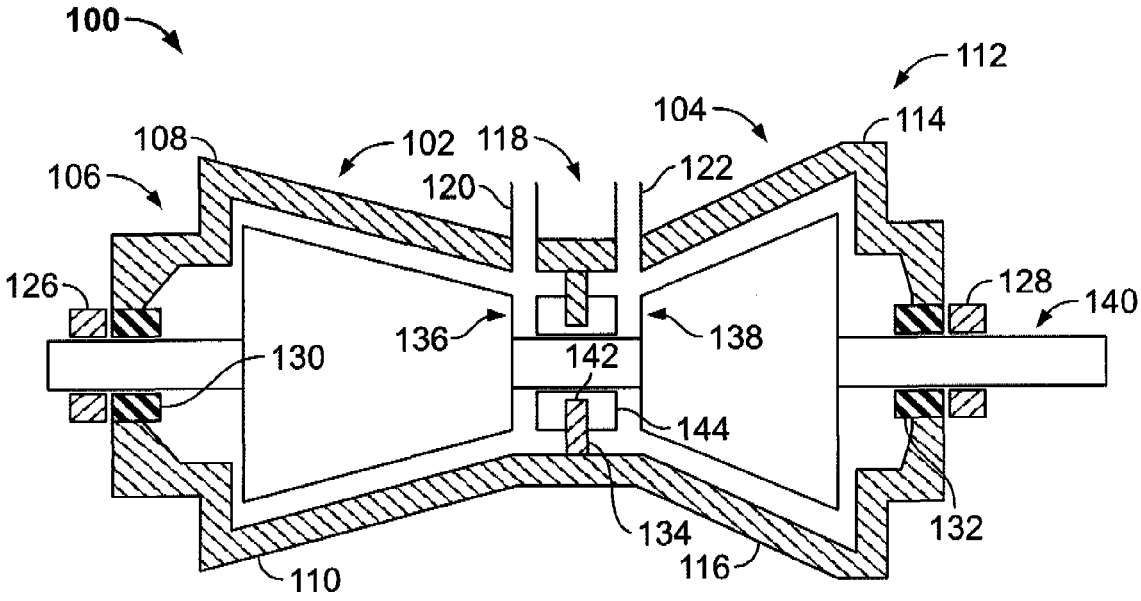
FIG. 1 is a cross-sectional schematic illustration of an exemplary opposed-flow steam turbine engine.

FIG. 1 is a cross-sectional schematic illustration of an exemplary opposed-flow steam turbine engine 100 including a high pressure (HP) section 102 and an intermediate pressure (IP) section 104. An HP shell, or casing, 106 is divided axially into upper and lower half sections 108 and 110, respectively. In the exemplary embodiment, shells 106 and 108 are inner casings. Alternatively, shells 106 and 108 are outer casings. A central section 118 positioned between HP section 102 and IP section 104 includes a high pressure steam inlet 120 and an intermediate pressure steam inlet 122. A nozzle box (not shown in FIG. 1) is fluidly coupled between each of high pressure steam inlet 120 and high pressure section 102, and intermediate pressure steam inlet 122 and intermediate pressure section 104.

During operation, high pressure steam inlet 120 receives high pressure/high temperature steam from a steam source, for example, a power boiler (not shown in FIG. 1). Steam flows from high pressure steam inlet 120 through a first nozzle box (not shown in FIG. 1), through an inlet nozzle 136, and through HP section 102, wherein work is extracted from the steam to rotate a rotor shaft 140 via a plurality of turbine blades, or buckets (not shown in FIG. 1) that are coupled to shaft 140.

In the exemplary embodiment, steam turbine 100 is an opposed-flow high pressure and intermediate pressure steam turbine combination. Alternatively, the present invention may be used with any individual turbine including, but not being limited to low pressure turbines. In addition, the present invention is not limited to being used with opposed-flow steam turbines, but rather may be used with steam turbine configurations that include, but are not limited to single-flow and double-flow turbine steam turbines.

Figure 2:
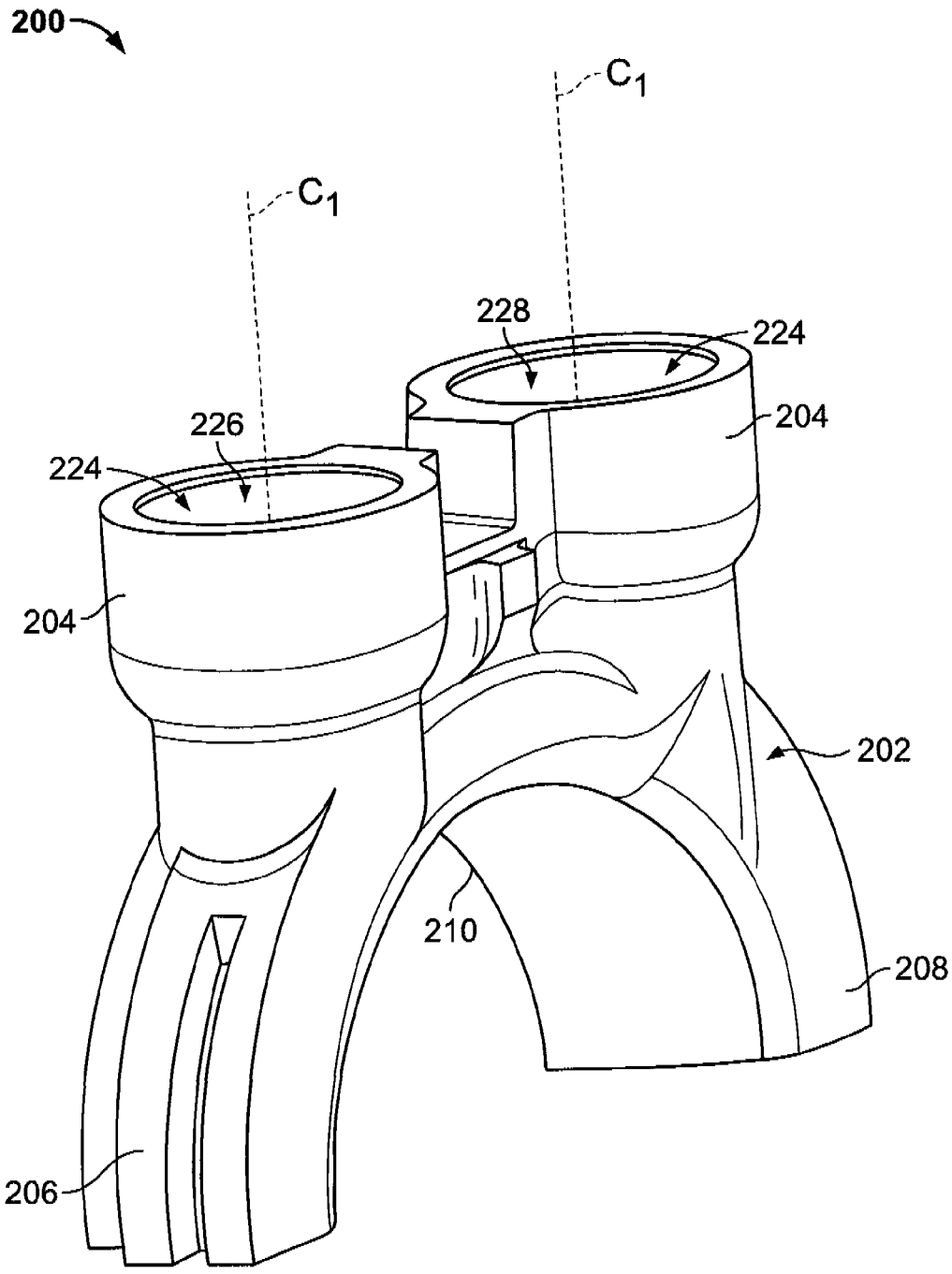
FIG. 2 is a perspective view of a nozzle box that may be used with the engine shown in FIG. 1.
Figure 3:
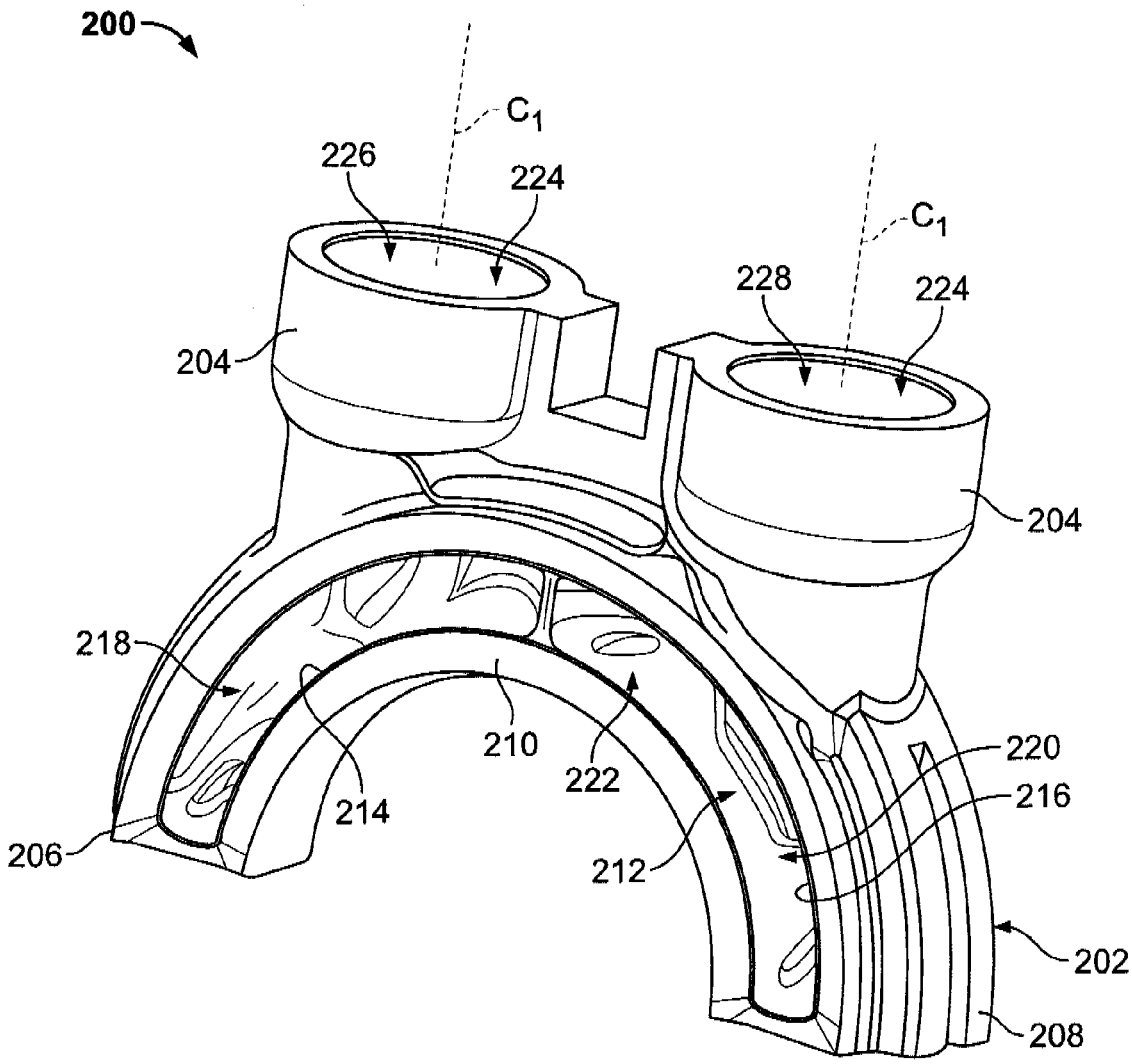
FIG. 3 is a partial cross-sectional view of the nozzle box shown in FIG. 2.

FIG. 2 is a perspective view of a steam turbine nozzle box 200 that may be used with steam turbine engine 100. In the exemplary embodiment, nozzle box 200 includes an annular chamber 202 and two inlets 204 coupled in flow communication with annular chamber 202, wherein each inlet 204 has an axial centerline $C_1$. FIG. 3 is a partial cross-sectional view of nozzle box 200 and annular chamber 202. In the exemplary embodiment, only a semi-circular half of annular chamber 202, is illustrated. In the exemplary embodiment, nozzle box 200 includes a vertical centerline $C_1$ spaced equidistant between each inlet 204. In alternative embodiments, nozzle box 200 may include more or less than two inlets 204.

Annular chamber 202 includes a first section 206, a second section 208, and a center section 210 extending integrally therebetween. In an embodiment having more or less than two inlets 204, annular chamber 202 may include more or less than three sections. Annular chamber 202 also includes a flowpath 212 defined by an inner annular wall 214 and an outer annular wall 216 that is radially outward from inner annular wall 214. Flowpath 212 includes a flowpath first section 218, a flowpath second section 220, and a flowpath center section 222. Specifically, in the exemplary embodiment, flowpath first section 218 is defined within chamber first section 206, flowpath second section 220 is defined within chamber second section 208, and flowpath center section 222 is defined within chamber center section 210. Furthermore, each inlet 204 includes a flowpath 224 formed therethough that is coupled in flow communication with flowpath 212. Specifically, a first inlet flowpath 226 is coupled in flow communication with flowpath first section 218, and a second inlet flowpath 228 is coupled in flow communication with flowpath second section 220.

During operation steam flows through inlets 204 into annular chamber 202. Specifically, steam is channeled through inlet flowpaths 226 and 228 and is discharged into annular chamber 202, wherein steam discharged from inlet flowpath 226 enters flowpath first section 218, and steam discharged from inlet flowpath 228 enters flowpath second section 220. Within annular chamber 202 flowpath first section 218 and flowpath second section 220 are coupled in flow communication with flowpath center section 222, such that annular chamber 202 facilitates providing a unitary flowpath 212 having an evenly distributed pressure therethrough. Specifically, steam channeled through inlet flowpaths 226 and 228 is mixed within annular chamber 202 such that steam discharged from nozzle box 200 has an even temperature and pressure. Steam is discharged from nozzle box 200 through a plurality of nozzles (not shown in FIG. 2) into a first stage of a turbine. The mixture of steam within annular chamber 202 facilitates discharging steam through each of the plurality of nozzles at an equal temperature and pressure. As such, vibrations within the first stage of the turbine are facilitated to be reduced.

Figure 4:
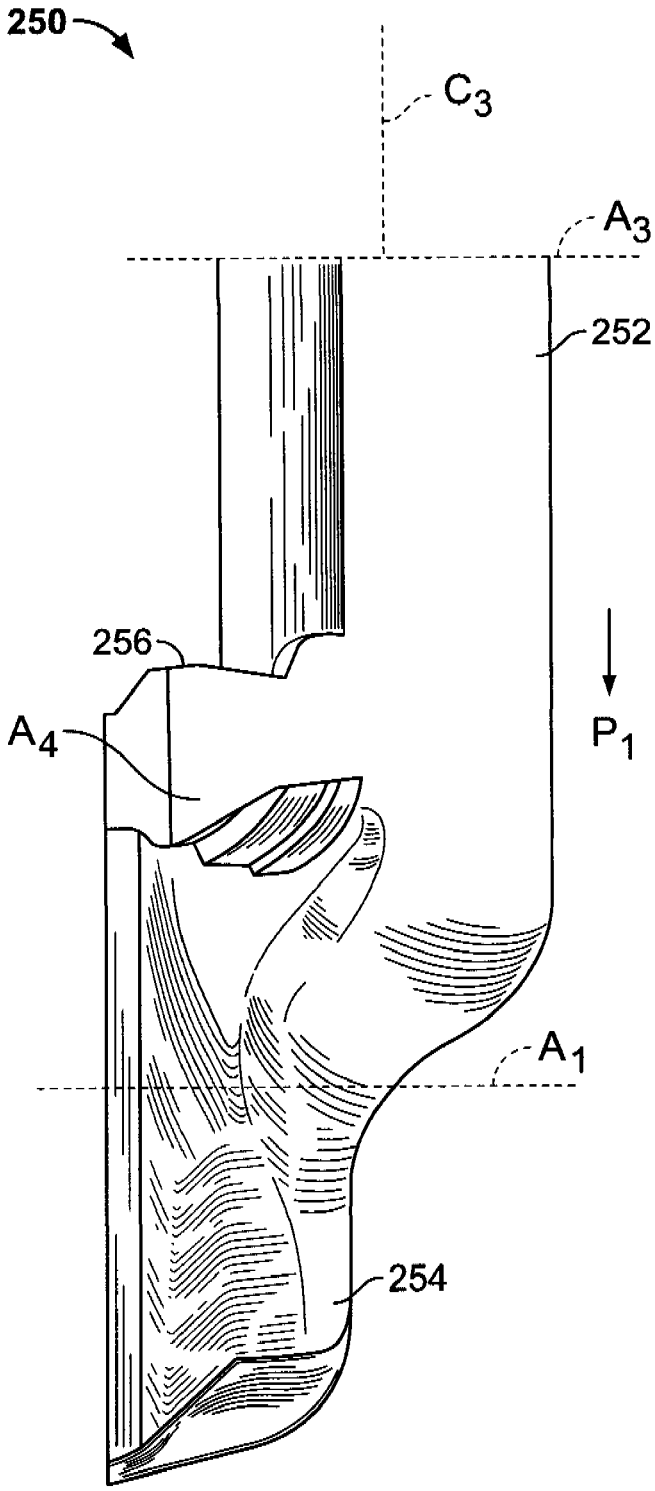
FIG. 4 (Prior Art)
FIG. 4 is a side view of a portion of a known flowpath through a nozzle box.
Figure 5:
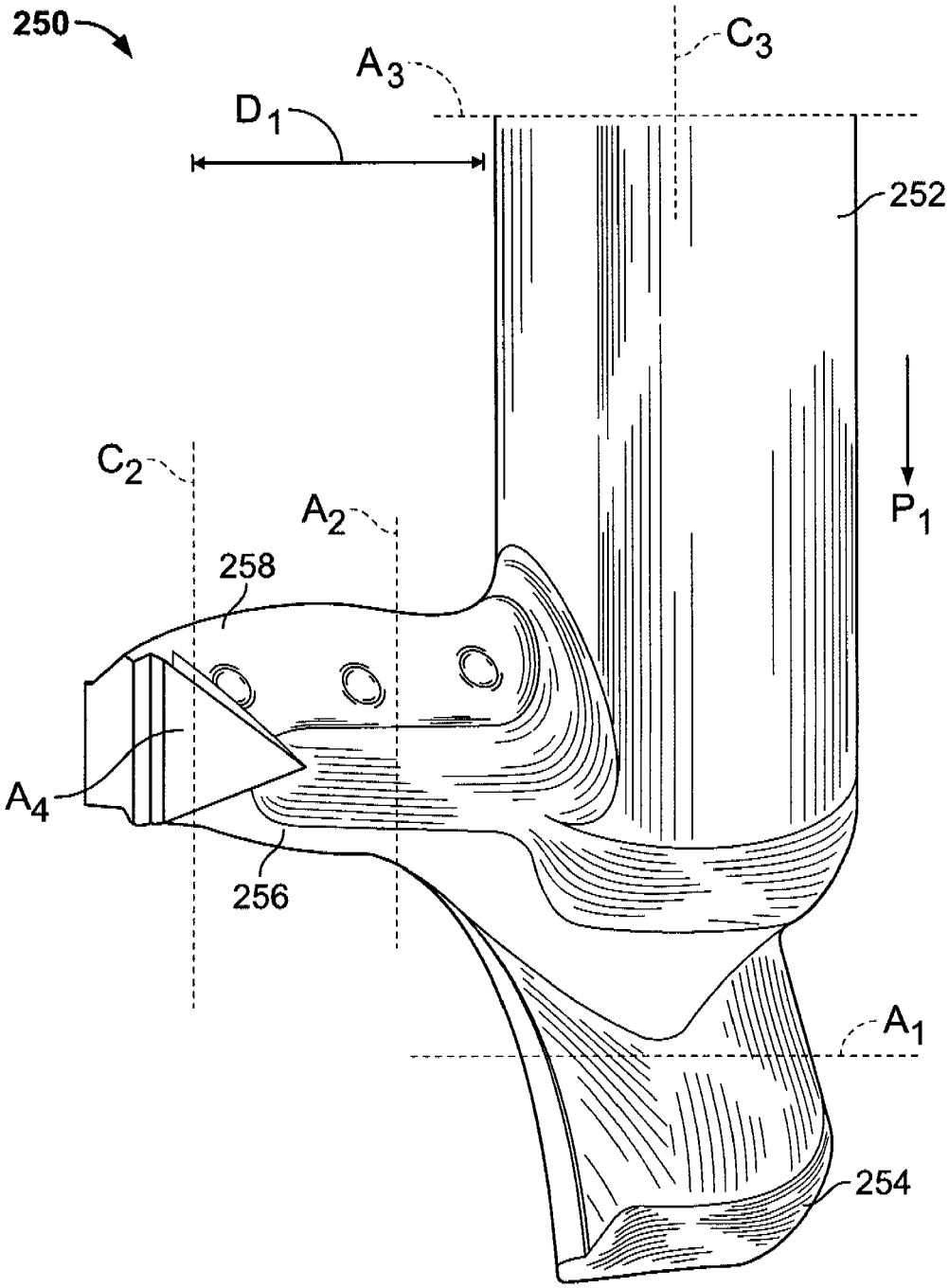
FIG. 5 (Prior Art)
FIG. 5 is a perspective view of the flowpath shown in FIG. 4.

FIG. 4 is a side view of a portion of a known flowpath 250 as defined by a portion of a known nozzle box. FIG. 5 is a perspective view of flowpath 250. Specifically, FIGS. 4 and 5 illustrate only a quarter-section of an annular flowpath 250. Flowpath 250 includes an inlet flowpath 252, a flowpath first section 254, and a flowpath center section 256. Flowpath sections 254 and 256 have substantially circular cross-sectional areas $A_1$ and $A_2$, respectively, defined at their intersection with inlet flowpath 252. Furthermore, in the exemplary embodiment, inlet flowpath 252 also has a circular cross-sectional area $A_3$. Moreover, flowpath center section 256 tapers to a triangular cross-sectional area $A_4$ at a distance $D_1$ from inlet flowpath 252.

During operation, steam channeled through inlet flowpath 252 is discharged into the known annular chamber through a discharge path $P_1$ that is substantially parallel to an inlet flowpath centerline $C_3$. Steam discharged from inlet flowpath 252 is channeled through flowpaths 254 and 256. However, because steam is discharged along path $P_1$ into a spherical terminus $S_1$, the steam does not mix evenly throughout flowpaths 254 and 256. Moreover, the cross-sectional areas $A_1$ and $A_2$ of flowpaths 254 and 256 limit the flow of steam throughout flowpaths 254 and 256, such that steam is not dispersed into an upper area 258 of center section flowpath 256.

Because steam flow dispersement is limited, steam-deprived pockets may form within the known annular chamber. For example, at least one steam-deprived pocket may form in area 258. The steam-deprived pockets result in an uneven distribution of steam pressure and temperature within the known annular chamber, which further results in an uneven distribution of steam pressure discharged from the known nozzle box. Specifically, the nozzles of at least some known nozzle boxes discharge steam at varying temperatures and pressures. However, discharging steam into a turbine at uneven pressures and temperatures may cause vibrations within the turbine, which may result in increasing maintenance costs of the turbine and/or may decrease the life-span of the turbine.

Figure 6:
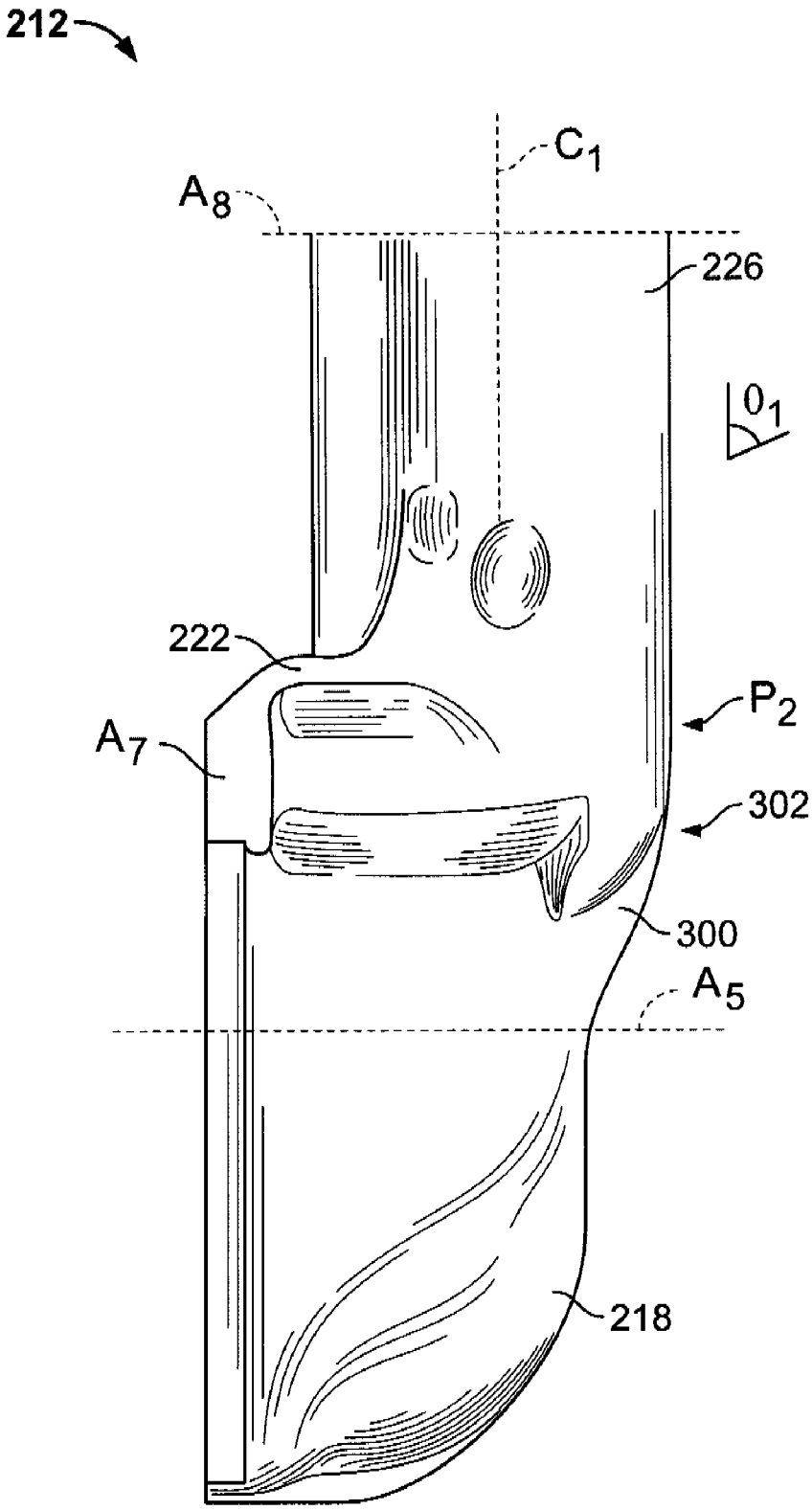
FIG. 6 is a side view of a portion of a flowpath through the nozzle box shown in FIGS. 2 and 3.
Figure 7:
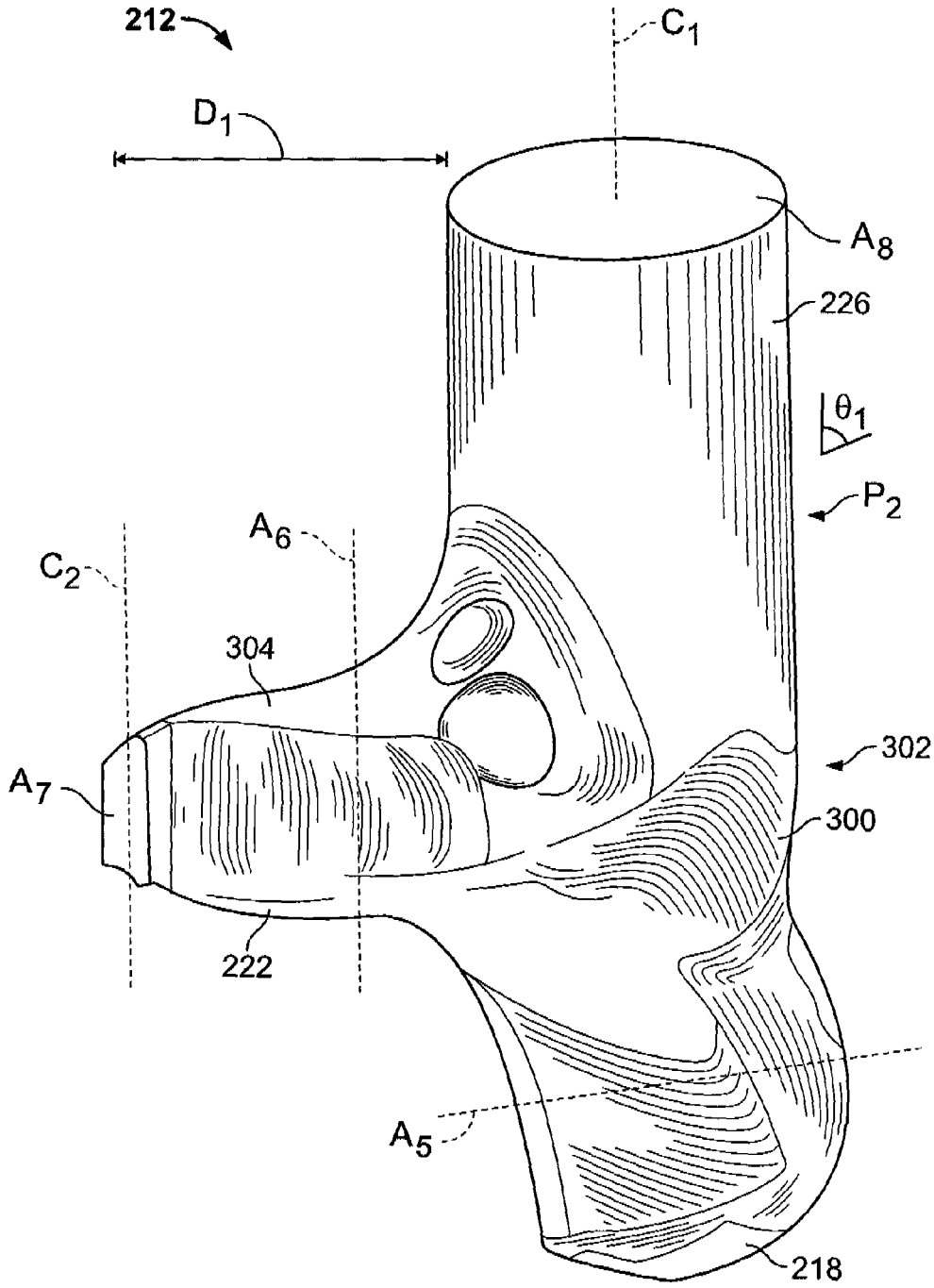
FIG. 7 is a perspective view of the flowpath shown in FIG. 6.

FIG. 6 is a side view of a portion of nozzle box flowpath 212 as defined by annular chamber 202. FIG. 7 is a perspective view of flowpath 212. Furthermore, FIGS. 6 and 7 illustrate only a quarter-section of annular flowpath 212. In the exemplary embodiment, inlet flowpath 226 is defined by inlet 204, flowpath first section 218 is defined by chamber first section 206, and flowpath center section 222 is defined by chamber center section 210.

Both flowpath first section 218 and flowpath center section 222 have respective elliptical cross-sectional areas $A_5$ and $A_6$ as defined by their intersection with inlet flowpath 226. Cross-sectional area $A_6$ transitions to a rectangular cross-sectional area $A_7$ a distance $D_1$ from inlet flowpath 226. Inlet flowpath 226 includes a circular cross-sectional area $A_8$, and a radius portion 300. Radius portion 300 is defined at an inlet flowpath end 302 positioned at an intersection between inlet flowpath 226, first section flowpath 218, and center section flowpath 222.

During operation, steam channeled through inlet flowpath 226 is discharged into annular chamber 202 in a discharge path $P_2$ that is defined at an oblique angle $\theta_1$ with respect to inlet centerline $C_1$ and at a tangent to the inner wall of flowpaths 218 and 222. More specifically, in the exemplary embodiment, path $P_2$ is oriented such that steam is discharged towards the second nozzle box inlet 204. As such, in the exemplary embodiment, steam discharged from the first inlet 204 is discharged towards the second inlet 204, and stream discharged from the second inlet 204 is discharged towards the first inlet 204. In alternative embodiments, steam may be discharged in any other suitable direction that is oblique with respect to inlet centerline $C_1$.

The combination of the orientation of path $P_2$ and cross-sectional areas $A_5$ and $A_6$ facilitates mixing steam discharged through inlet flowpath 226. Specifically, steam mixes within flowpaths 218 and 222. Moreover, cross-sectional areas $A_5$ and $A_6$ of flowpaths 218 and 222 provide a larger torodial area within which steam can mix, enabling the steam to fill the entirety of flowpaths 218 and 222. More specifically, steam is enabled to fill steam-deprived pockets, such as a pocket 304 that may be formed in flowpath 222 near vertical centerline $C_2$. Furthermore, the greater tordial area in combination with steam flow along path $P_2$ facilitates an enhanced mixing of steam within annular chamber 202. As such, pressure and temperature throughout annular chamber 202 is facilitated to distribute evenly. Resultantly, steam discharged through each nozzle of nozzle box 200 is facilitated to have an even pressure and temperature distribution when discharged into a turbine. As such, vibrations within the turbine are facilitated to be reduced, enabling greater turbine efficiency and life-span.

Figure 8:
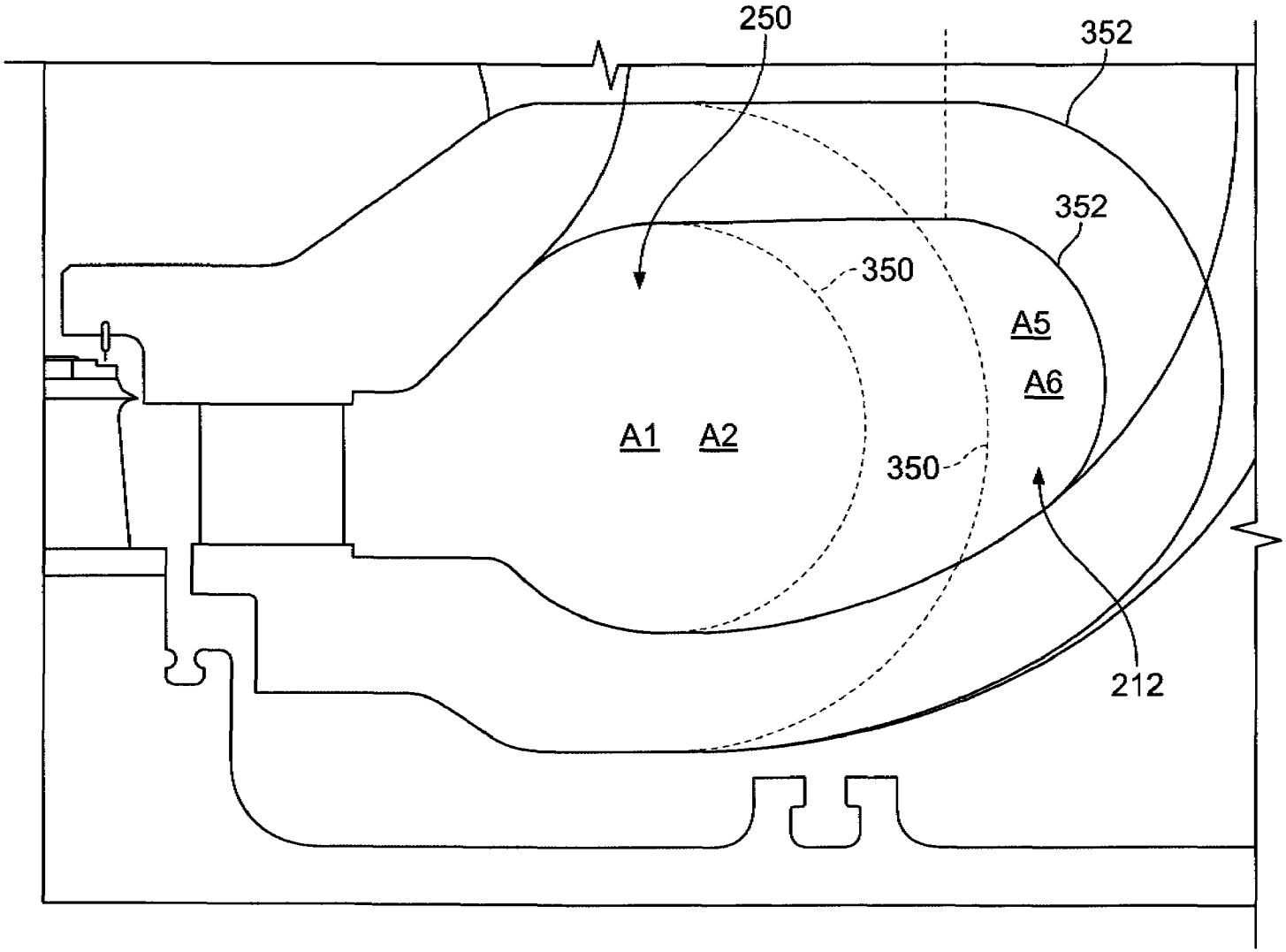
FIG. 8 is a schematic cross-sectional view of the flowpaths shown in FIGS. 4 and 5 superimposed on a cross-sectional view of the flowpaths shown in FIGS. 6 and 7.

FIG. 8 is a cross-sectional view of flowpath 212 superimposed on a cross-sectional view of flowpath 250. Specifically, FIG. 8 is a comparison of circular cross-sectional areas $A_1$ and $A_2$ compared to elliptical cross-sectional areas $A_5$ and $A_6$.

Flowpath 250 is indicated by dashed lines 350, and flowpath 212 is indicated by solid lines 352.

The above-described methods and apparatus facilitate improving turbine efficiency by evenly distributing the pressure and temperature of steam discharged from a nozzle box. Specifically, the nozzle box includes an elliptical cross-sectional area and an inlet flowpath that discharges steam into the nozzle box at an oblique angle with respect to the nozzle box inlets. The elliptical cross-sectional area and the enhanced flowpath facilitate evenly distributing steam throughout the nozzle box. As such, steam-deprived pockets within the nozzle box are prevented, and steam pressure and temperature throughout the nozzle box is facilitated to be evenly distributed. By evenly distributing steam pressure and temperature throughout the nozzle box, the pressure and temperature of steam discharged into the turbine is likewise evenly distributed, facilitating fewer vibrations within the turbine, and, thus, increasing the useful life of the turbine and decreasing maintenance costs associated with the turbine.

As used herein, an element or step recited in the singular and proceeded with the word "a" or "an" should be understood as not excluding plural said elements or steps, unless such exclusion is explicitly recited. Furthermore, references to "one embodiment" of the present invention are not intended to be interpreted as excluding the existence of additional embodiments that also incorporate the recited features.

Although the apparatus and methods described herein are described in the context of a nozzle box for a steam turbine, it is understood that the apparatus and methods are not limited to nozzle boxes or steam turbines. Likewise, the nozzle box components illustrated are not limited to the specific embodiments described herein, but rather, components of the nozzle box can be utilized independently and separately from other components described herein.

While the invention has been described in terms of various specific embodiments, those skilled in the art will recognize that the invention can be practiced with modification within the spirit and scope of the claims.

What is claimed is:

1. A method of fabricating a steam turbine nozzle box, said method comprising:

forming an annular chamber defined by a radially outer wall and a radially inner wall, and coupling a plurality of inlets in flow communication with the annular chamber such that steam is discharged from each of the plurality of inlets into the chamber at an oblique discharge angle with respect to an inlet axial centerline, wherein a first flowpath is defined in the annular chamber, the first flowpath having a cross-sectional area that transitions from a substantially elliptical shape at an intersection with a first inlet flowpath to a substantially rectangular shape adjacent to a second inlet flowpath.

2. A method in accordance with claim 1 further comprising coupling a plurality of nozzles in flow communication with the annular chamber.

3. A method in accordance with claim 1 wherein said coupling a plurality of inlets in flow communication with the annular chamber further comprises:

positioning a first inlet to discharge steam into the annular chamber towards a second inlet; and positioning the second inlet to discharge steam into the annular chamber towards the first inlet.

4. A method in accordance with claim 1 wherein forming an annular chamber further comprises forming a second flowpath in the annular chamber that has a substantially elliptical cross-sectional area.

5. A method in accordance with claim 1 wherein said coupling a plurality of inlets further comprises positioning the plurality of inlets to facilitate distributing steam flow substantially evenly across the annular chamber.

6. A method in accordance with claim 1 wherein said coupling a plurality of inlets further comprises positioning the plurality of inlets to distribute steam across the chamber such that steam-deprived pockets within the annular chamber are facilitated to be prevented.

7. A method in accordance with claim 1 wherein said coupling a plurality of inlets further comprises positioning the plurality of inlets to facilitate distributing a pressure of the steam substantially evenly across the chamber.

8. A steam turbine nozzle box comprising:

an annular chamber defined by an outer annular wall and an inner annular wall that is radially inward from said outer annular wall and a plurality of inlets coupled in flow communication with said annular chamber, said inlets positioned to facilitate discharging steam into said annular chamber at an oblique discharge angle with respect to an inlet axial centerline, said annular chamber comprises a first flowpath having a cross-sectional area that transitions from a substantially elliptical shape at an intersection with a first inlet flowpath to a substantially rectangular shape adjacent to a second inlet flowpath.

9. A nozzle box in accordance with claim 8 further comprising a plurality of nozzles coupled in flow communication with said annular chamber.

10. A nozzle box in accordance with claim 8 wherein a first of said plurality of inlets is oriented to discharge steam into said annular chamber towards a second of said plurality of inlets, said second inlet is oriented to discharge steam into said annular chamber towards said first inlet.

11. A nozzle box in accordance with claim 8 wherein said annular chamber comprises a second flowpath having a substantially elliptical cross-sectional area.

12. A nozzle box in accordance with claim 8 wherein said plurality of inlets facilitate distributing steam flow substantially evenly within said annular chamber.

13. A nozzle box in accordance with claim 8 wherein said plurality of inlets facilitate preventing steam-deprived pockets from forming within said annular chamber.

14. A nozzle box in accordance with claim 8 wherein said plurality of inlets facilitate discharging steam with a substantially equal pressure across said chamber.

15. A steam turbine comprising:

a turbine; and a nozzle box configured to channel steam into said nozzle box for use with said turbine, said nozzle box comprises an annular chamber, a plurality of inlets, and a plurality of nozzles, said annular chamber is defined by an outer annular wall and an inner annular wall that is radially inward from said outer annular wall, said plurality of inlets are coupled in flow communication with said annular chamber such that said inlets discharge steam therefrom into said annular chamber at an oblique discharge angle with respect to an inlet axial centerline, said plurality of nozzles are coupled in flow communication with said annular chamber and are configured to discharge steam towards said turbine, said annular chamber comprises a first flowpath having a cross-sectional area that transitions from a substantially elliptical shape at an intersection with a first inlet flowpath to a substantially rectangular shape adjacent to a second inlet flowpath.

16. A steam turbine in accordance with claim 15 wherein a first of said plurality of inlets is oriented to discharge steam into said annular chamber towards a second of said plurality of inlets, said second inlet is oriented to discharge steam into said annular chamber towards said first inlet.

17. A steam turbine in accordance with claim 15 wherein said annular chamber comprises a second flowpath having a substantially elliptical cross-sectional area.

18. A steam turbine in accordance with claim 15 wherein said plurality of inlets facilitate distributing steam flow substantially evenly within said annular chamber.

19. A steam turbine in accordance with claim 15 wherein said plurality of inlets facilitate preventing steam-deprived pockets from forming within said annular chamber.

20. A steam turbine in accordance with claim 15 wherein said plurality of inlets facilitate discharging steam with a substantially equal pressure across said chamber.

* * * * *